US005718140A

United States Patent [19]

Koestermeier et al.

[11] Patent Number: 5,718,140

[45] Date of Patent: Feb. 17, 1998

[54] METHOD FOR MANUFACTURING A ROTATIONALLY SYMMETRICAL WORK-PIECE OF STEEL

[75] Inventors: Karl-Heinz Koestermeier, Rietberg, Germany; Mario Zanet, Windsor Ontario, Canada; Jürgen Köppel, Im Lehmkühlchen 24, D-59269 Beckum, Germany

[73] Assignees: Liefeld GmbH & Co., Ahlen, Germany; General Motors Corp., Detroit, Mich.; Jürgen Köppel, Beckum, Germany

[21] Appl. No.: 703,332

[22] Filed: Aug. 26, 1996

Related U.S. Application Data

[63] Continuation of Ser. No. 372,943, Jan. 17, 1995, abandoned.

[30] Foreign Application Priority Data

Oct. 24, 1994 [DE] Germany ..... 4438112.3

[51] Int. Cl.[6] ..... B21B 27/06; B21D 5/00; B21D 22/14

[52] U.S. Cl. ..... 72/71; 72/83

[58] Field of Search ..... 72/71, 83, 84, 72/85, 110; 492/28

[56] References Cited

U.S. PATENT DOCUMENTS

| | | | |
|---|---|---|---|
| 2,379,584 | 7/1945 | Litton | 72/83 |
| 3,566,503 | 3/1971 | Pacak | 72/83 |
| 4,532,786 | 8/1985 | Schaible | 72/71 |
| 4,936,129 | 6/1990 | Lipper et al. | 72/83 |

*Primary Examiner*—Lowell A. Larson
*Assistant Examiner*—Rodney A. Butler
*Attorney, Agent, or Firm*—Hill, Steadman & Simpson

[57] ABSTRACT

A method for manufacturing a work-piece which is rotationally symmetrical about an axis is provided wherein the work-piece has a spindle and at least one hollow member connected with the spindle by a hub part extending in radial direction. The method includes the steps of producing a work-piece blank having the rotationally symmetrical spindle and an integral, rotationally symmetrical, radially outwardly extending circumferential flange; mechanically processing the work-piece blank by at least one of boring, turning, milling, pressing, and grinding; and rolling a radially outer part of the flange to form the hollow member and leaving a remainder of the flange unchanged to form the hub. A roller is also provided for radially splitting the flange into three wings. The roller has two axially spaced splitting edges separated by a groove which has a rectangular cross-section.

16 Claims, 12 Drawing Sheets

METHOD FOR MANUFACTURING A ROTATIONALLY SYMMETRICAL WORK-PIECE OF STEEL

RELATED APPLICATION

This application is a continuation of U.S. Ser. No. 08/372,943, filed Jan. 17, 1995, now abandoned.

BACKGROUND OF THE INVENTION

The invention relates to a method for manufacturing a rotationally symmetrical work-piece of steel consisting of a hardened spindle and at least one hollow member connected with the spindle by a hub part extending in radial direction wherein the following method steps are performed:

a) a work-piece blank is produced, b) the work-piece blank is mechanically processed by boring and/or turning and/or milling and/or pressing and/or grinding, and c) the hollow member is produced.

A method of the type described above is known from practical experience of metal processing and is, e.g., used for the manufacturing of gear or clutch parts for motor cars. The method mentioned above commonly is accomplished such that, firstly and separately, a hollow member is produced together with the hub part thereof, wherein the hub part comprises a central opening. The inner diameter of the central opening is somewhat larger than the outer diameter of the spindle, which is also separately produced with respect to the outer diameter at that part where the hub part is situated. After pushing the hollow member with the hub part thereof onto the spindle, both parts are connected with each other by a circumferential welding.

It is a disadvantage of this known method that the separate manufacture of two separate parts and the welding thereof requires a high amount of labor and therefore is uneconomical. Furthermore, the welding connection between the hub part of the hollow member and the outer circumference of the spindle is a potential weakness of the finished work-piece, whereby the reliability of the work-piece in later use is not always guaranteed. Finally, it is a disadvantage that by the welding, high thermical tensions within the individual parts forming the work-piece occur with the tensions leading to aberrations in shape and dimension, therefore requiring accurate controls of the manufacturing, and often refinishing, to guarantee the preset tolerances. Therein the main problem occurs, that the parts of the spindle positioned within or below the hollow member, and the surfaces of the hollow member pointing inwards, are often inaccessible for a refinishing or are accessible only under difficult circumstances.

In order to avoid the disadvantages caused by the welding connection, an integral work-piece blank may be produced theoretically, e.g., by casting with the blank already comprising a hollow member which is subsequently shaped into the finished work-piece by machining. However, the obstacle of the inaccessibility of individual parts of the work-piece also occurs here which is difficult to or hardly overcome. Therefore this approach to manufacturing a work-piece of the kind mentioned before either is completely impossible or not practical for cost reasons.

SUMMARY OF THE INVENTION

It is therefore an object of the present invention to provide a method of the kind mentioned before wherein the disadvantages mentioned are avoided and wherein particularly a more economical manufacturing of the work-pieces of the kind mentioned before is possible. Furthermore, it is an object of the invention to produce such work pieces with no weaknesses and a high accuracy in shape and dimension with a smaller effort for manufacturing than has been possible before.

According to the invention this object is attained by a method of the kind mentioned above wherein in step a), an integral outwardly protruding circumferential flange-like extension is formed at the work-piece blank, and in step c), the radially outer part of the flange-like extension is formed into the hollow member by rolling.

According to the invention it is advantageously possible to produce an integral work-piece of the kind mentioned above. Thereby the welding which is required in the state of the art, with the potential weaknesses in the finished work-piece, may be eliminated such that the work-piece has higher strength and durability. Furthermore, the thermical stress is eliminated which is caused by the welding, such that the disadvantageous impact on the accuracy regarding the shapes and dimension no longer occurs. Furthermore, it is advantageously possible with the method according to the invention, that parts of the work-piece blank forming the spindle are accessible to the outer circumference thereof during the processing thereof, whereby this part of the method is easily and comparatively quickly accomplished. The circumferential area of the part of the work-piece blank forming the spindle may be completely machined and only thereafter the hollow member is generated by rolling. Thereby, the method according to the invention enables a very economical production of work-pieces of the kind mentioned, with a significantly improved quality of the work-pieces.

In a first embodiment of the method according to the invention it is provided that during step c), the hollow member is formed extending from the hub part to one side as seen in axial direction (extending in one axial direction from the hub). With this embodiment of the method it is possible to shape a hollow member with a cup or bell-like form.

An alternate embodiment of the method in relation to the embodiment mentioned before provide that step c) is divided into a part-step c1), wherein the radially outer part of the flange-like extension is split into two wings in radial direction or lobarly thickened, and into a part-step c2), wherein the hollow member is formed out of the split or thickened part of the extension extending from the hub part to both sides as seen in axial direction. This embodiment of the method enables the shaping of a hollow member with the hub part thereof not necessarily positioned at one or the other of the axial ends of the hollow member, but arranged in spaced relation thereof. Therein the position of the hub part in relation to the outer part of the hollow member may be symmetric, i.e., in the middle, or asymmetric, e.g., off center. The two part areas of the hollow member at both axial sides of the hub part may be provided with different diameters at the inner circumference and/or outer circumference thereof.

Two further embodiments of the method according to the invention are disclosed wherein two different hollow members, respectively, are produced out of the flange-like extension. In one embodiment, firstly a hollow member with a relatively large axial length is produced extending to both sides of the flange-like extension, and subsequently a second hollow member with a shorter axial length is produced positioned axially outside of the first hollow member and encompassing the first hollow member along a part of the axial length thereof. The other embodiment produces a work-piece wherein the position of the two hollow members is reversed, i.e., firstly a radially inner hollow member is produced comprising a relatively small axial length and extending only from one axial side of the flange-like extension, and subsequently a second hollow member is produced positioned radially outside of the first one, with the second hollow member comprising a larger diameter and also a larger axial extension than the first hollow member, with the outer hollow member extending to both axial sides of the flange-like extension or the hub part, respectively.

It is a feature of the last described embodiments of the method according to the invention that in total three wings are produced by splitting out of the flange-like extension. Therein this splitting may selectively be accomplished either simultaneously by two split rollers or by a single double split roller, or two single split rollers may be used one after the other. The selection depends on how the method may be optimized in the sequence thereof and may be left to the judgment of the fabricator.

According to the invention, the method enables one to produce the widest variety of work-pieces such that the method is useable in a broad scope and therefore very economical.

In order to produce work-pieces with the method according to the invention comprising particularly high strength values and wear resistancy values, without hindering the accomplishment of method step c) with the rolling, it is provided that between steps b) and c), the work-piece blank is surface hardened wherein the surface hardening of the work-piece blank is accomplished only in the part thereof forming the spindle while avoiding the flange-like extension. This partial surface hardening may be accomplished by inductive hardening as an example.

A further alternate method step is that between steps a) and b) the work-piece blank is normalized by heat treatment. This method step particularly is accomplished when during the production of the work-piece blank in step a) particular tensions are created therein, as an example when producing it by forging. As an alternative, the work-piece blank may be produced by casting or by machining out of the full material.

In order to avoid small aberrations in dimensions or surplus material eventually present after the rolling, it is provided in a further step d), the hollow member is turned and/or ground and/or cut into length at the front side(s) thereof.

Furthermore, the method according to the invention provides that during step c), the radially outer part of the flange-like extension is flow-turned into the hollow member while thinning the material and axially enlarging the length thereof. Hereby the possibility is created to also generate hollow members with a relatively large axial extension in one or more roller operations wherein simultaneously more advantageous structure properties are attained.

Further, the method according to the invention offers the advantageous possibility that during the forming of the hollow member by rolling, the hollow member is provided with an inner and/or outer profile. The generation of inner and/or outer profiles by rolling is known as such and needs no further explanation here. The inner and/or outer profiles, as an example, are toothed wheel works such as those provided at gear or clutch parts.

A further development of an embodiment of the method according to the invention provides that the hollow member has an inner profile varying in the radial depth thereof as seen in circumferential direction, and that a serration is subsequently formed by turning the outer circumference of the hollow member in the frontal end area thereof. Preferably a serration may thus be produced comprising rectangular teeth in lateral view like a crown, since it may be used, e.g., for a jaw clutch.

Finally, the invention relates to a special roller particularly suitable for carrying out further embodiments of the method according to the invention, however, which may be used for other applications independent from the methods described above. This special roller is characterized in that it is shaped as a double split roller with two axially spaced split edges wherein a groove with a rectangular cross-section is positioned between the two split edges. With this special split roller, two splitting operations may be accomplished simultaneously in a single step with little effort, wherein the material processed is split into three wings in radial direction. Therein the two outer wings are laterally bent in two opposite directions according to the wedge angle of the split edges, whereas the central material area forming the middle one of the three resulting wings is received by the groove in the roller with no deformation or formation resulting. Advantageously the splitting is simplified and accelerated with such a roller and at the same time a better quality results because the work-piece is not stressed asymmetrically with this special double split roller as it is the case with a single split roller with only a single splitting edge.

BRIEF DESCRIPTION OF THE DRAWINGS

An embodiment of the invention is further explained referring to the drawings.

DETAILED DESCRIPTION OF THE PREFERRED EMBODIMENTS

Figure 1:
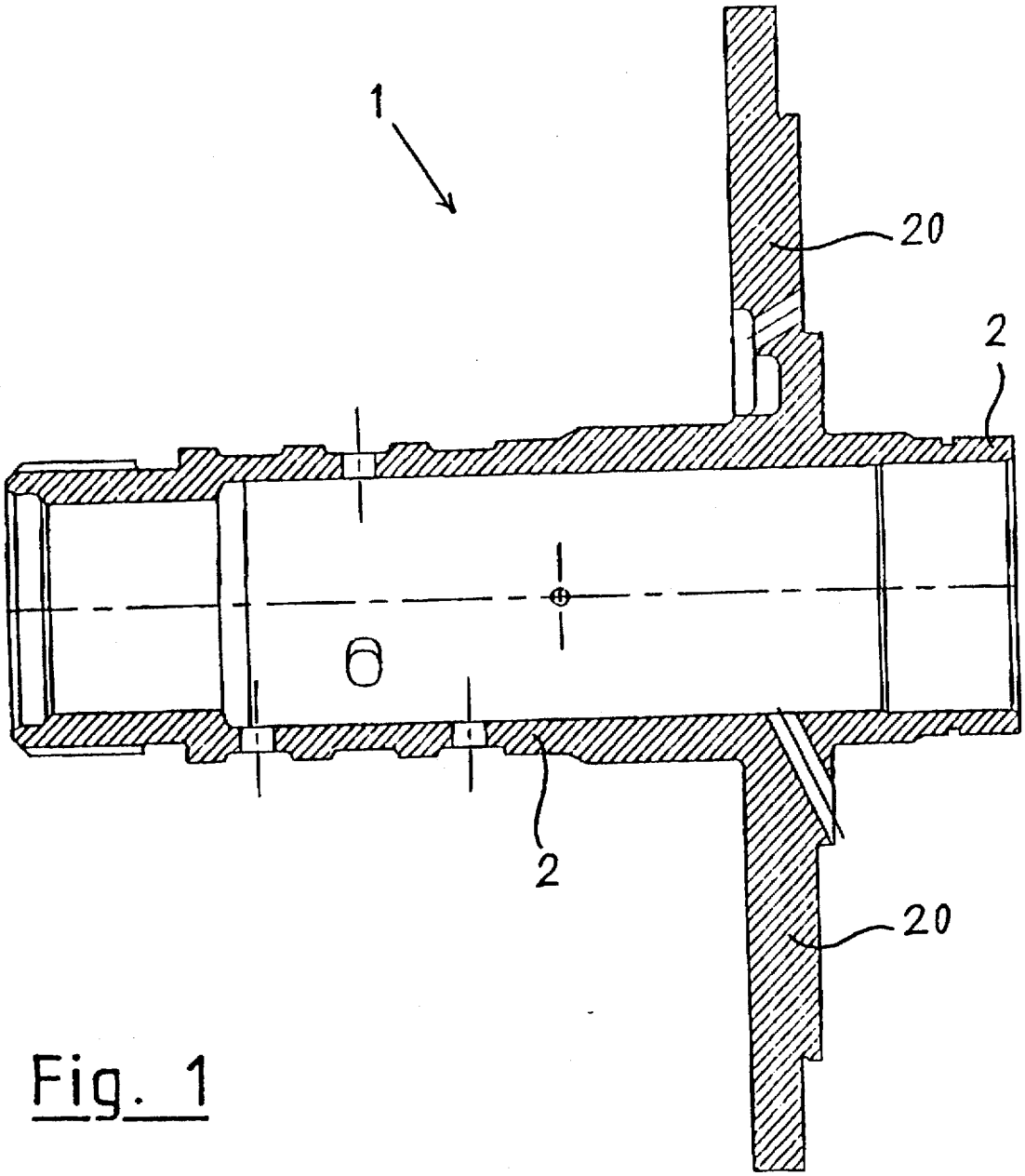
FIG. 1 is a first work-piece blank after the machining thereof and prior to the forming by rolling, in a longitudinal section.

As illustrated in FIG. 1 of the drawing, the illustrated embodiment of a first work-piece blank 1 consists of a spindle 2 which is designed as a hollow spindle in this case, and a flange-like extension 20 extending from the outer circumference of the spindle 2 circumferentially in a radial outward direction. Furthermore FIG. 1 illustrates that the work-piece blank 1, already by the machining of the surfaces thereof, comprises an outer contour required for the planned purpose and borings. Furthermore, in the condition of the work-piece blank 1 illustrated in FIG. 1, the area forming the spindle 2 may be surface hardened wherein the extension 20 is eliminated from this hardening. Therefore the extension 20 comprises the original lesser material hardness not influenced by the surface hardening, wherein the material of the illustrated embodiment is steel.

Figure 2:
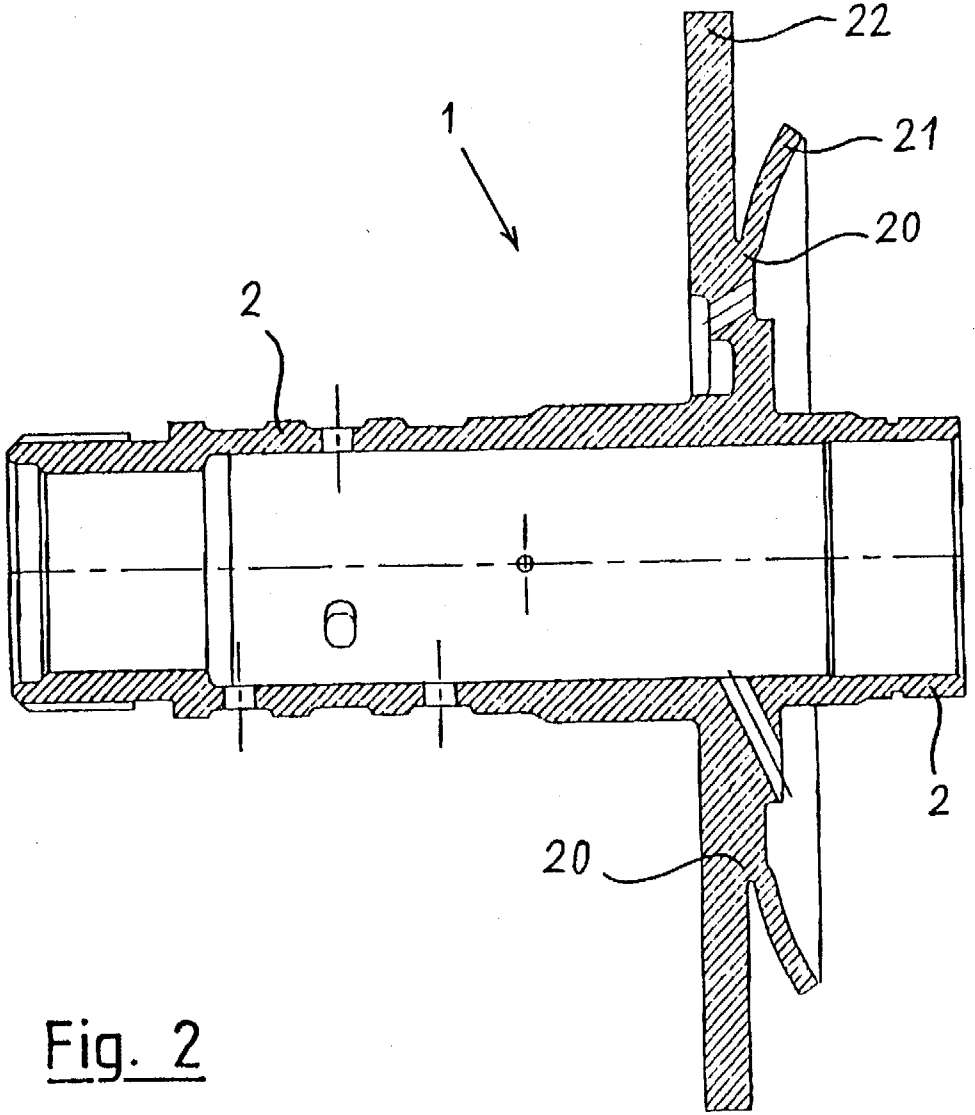
FIG. 2 is the work-piece blank of FIG. 1 during the forming thereof by rolling.

FIG. 2 of the drawing illustrates the work-piece blank 1, also in longitudinal section as in FIG. 1, during a first forming of the extension 20 by pressing. Obviously the extension 20 is split in radial direction from the outside to the inner side whereby the extension 20 is now divided into two extension wings of different thickness and different length (in radial direction). This division is accomplished by moving a split roller in a radial direction from the outside to the outer circumference of extension 20 as is known from the technique of rolling as such.

Figure 3:
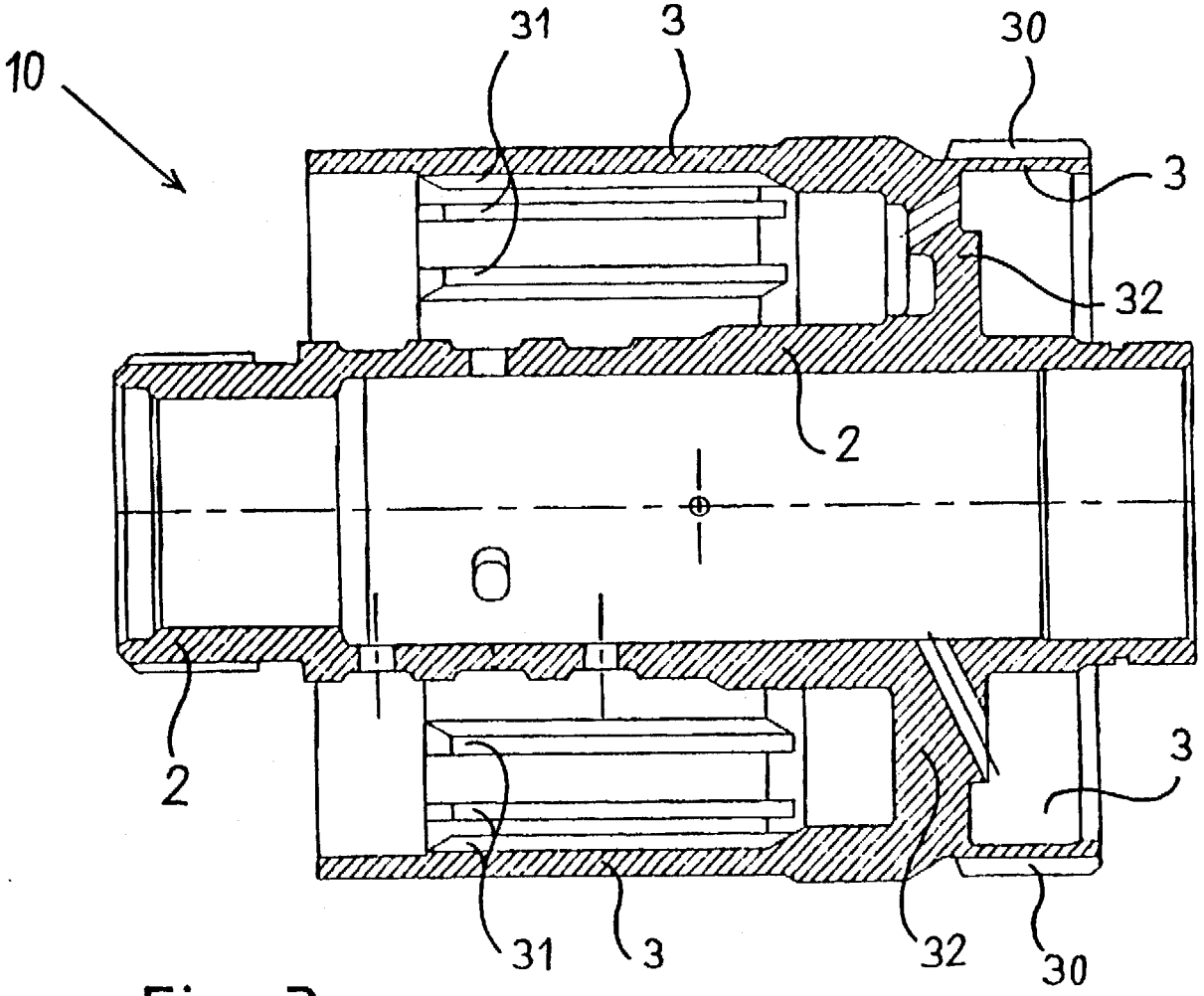
FIG. 3 is a finished work-piece manufactured out of a work-piece blank according to FIGS. 1 and 2.

FIG. 3 of the drawing illustrates, in the same way as in FIGS. 1 and 2, a first finished work-piece 10 formed out of a first work-piece blank has been formed by further forming, by rolling out of the extension 20 illustrated in split condition in FIG. 2, with the hollow member 3 extending coaxially to the spindle 2 and encompassing the spindle 2 along a part of the length thereof. By means of a hub part 32 formed out of the radial inner area of the extension 20, the hollow member 3 is integrally connected with the spindle 2. Furthermore, FIG. 3 illustrates that with the illustrated example, the hollow member 3 extends from the hub part 32 to both sides as seen in axial direction. Therein the part of the hollow member 3 extending from the hub part 32 to the left is formed by flow-turning out of the larger wing of the split extension 20 visible in FIG. 2, and the part of the hollow member 3 extending from the hub part 32 to the right side according to FIG. 3 is formed out of the smaller wing of the split extension 20 shown in FIG. 2.

The part of the hollow member 3 extending from the hub part 32 to the left side in FIG. 3 simultaneously has been provided, by means of flow-turning at the inner circumference thereof, with a profile 31, in this case an inner toothed wheel work extending in axial direction. The outer circumference of this part of the hollow member 3 extending to the left side from the hub part 32 is not contoured.

In contrast, the outer circumference of the part of the hollow member 3 extending from the hub part 32 to the right side has been provided with a profile 30 which in this case is an outer toothed wheel work extending in axial direction. The inner circumference of this part of the hollow member 3 is not contoured.

When comparing FIGS. 2 and 3 of the drawing, it is obvious that out of the extension 20 with a relatively large material thickness in axial direction, the hollow member 3 has been formed with a substantially smaller material thickness in radial direction which has been accomplished by flow-turning and simultaneous thinning and elongating the material when providing it with a profile. Hereby simultaneously an improvement in the structure within the material forming the hollow member 3 is attained, which improves the strength thereof.

Figure 4:
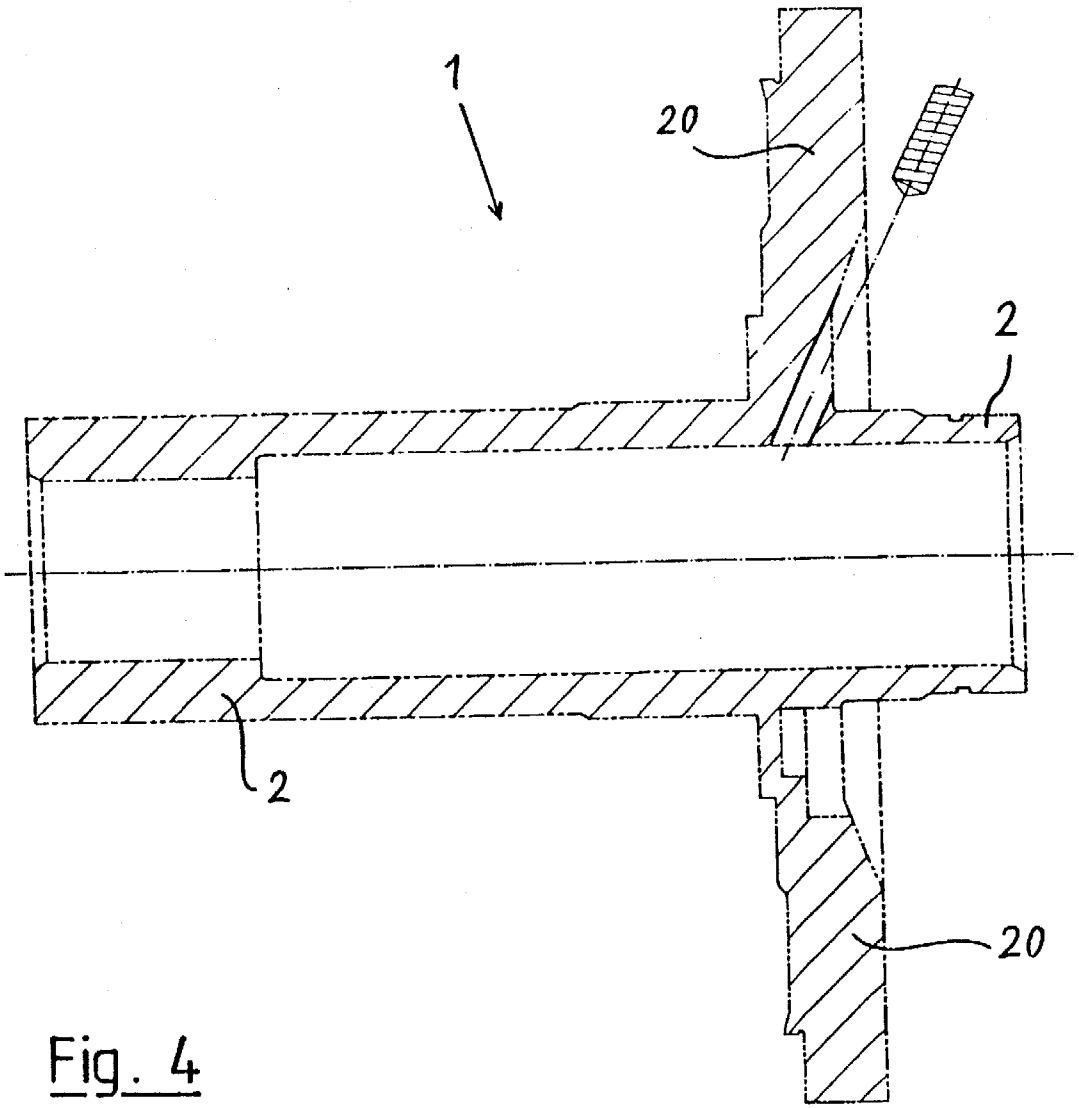
FIG. 4 is a second work-piece blank after the machining thereof and prior the forming by rolling, in a longitudinal section.

FIG. 4 of the drawing illustrates a work-piece blank 1 after machining which also is comprised of a hollow spindle 2 and a flange-like extension 20 extending therefrom outwards.

Figure 5:
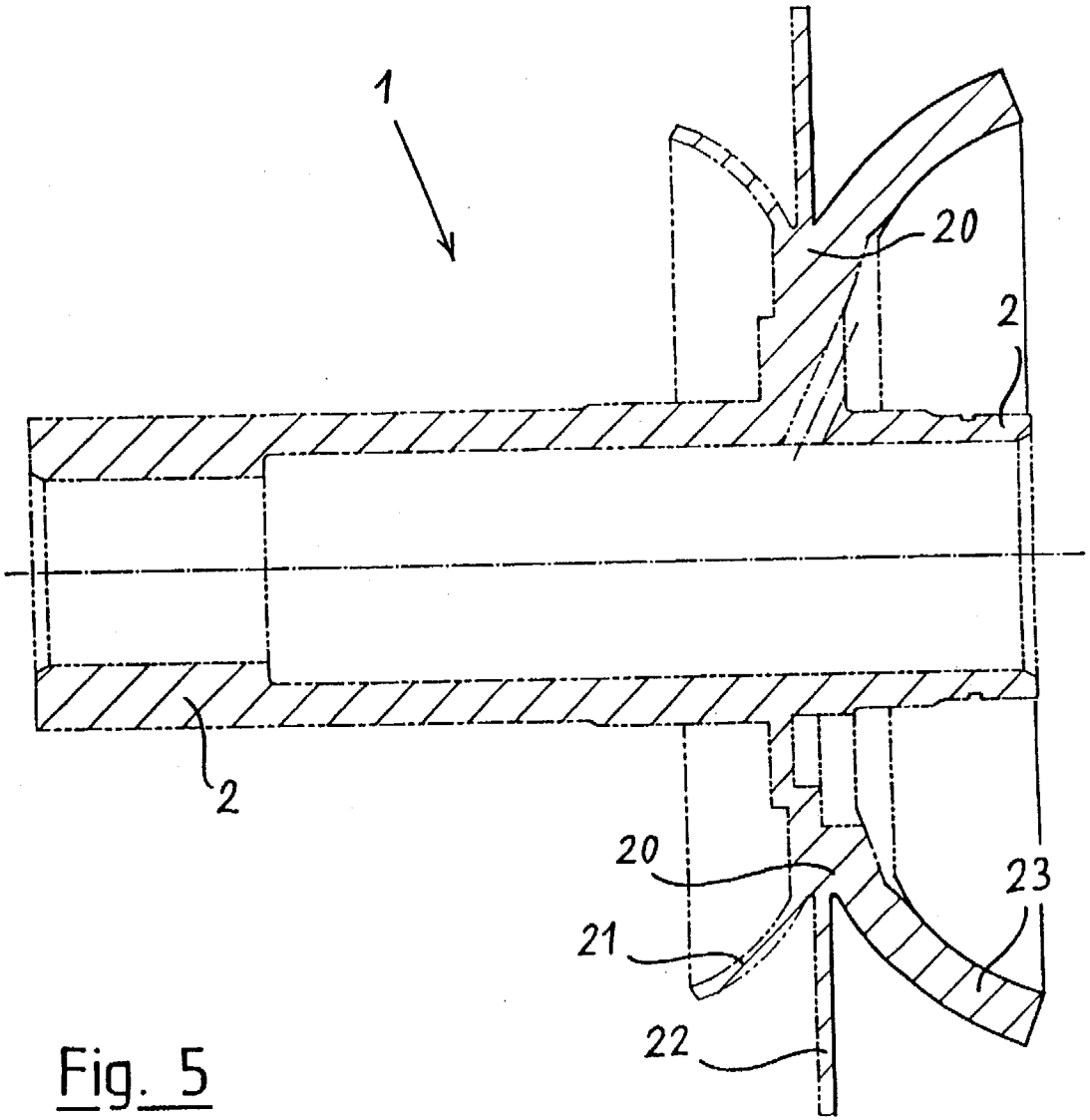
FIG. 5 is the work-piece blank of FIG. 4 during the forming thereof by rolling.

This work-piece blank 1 is split by rolling in the area of the flange-like extension 20 thereof into three wings 21, 22, 23 as shown in FIG. 5, wherein obviously the three wings comprise different dimensions in radial and axial directions.

Figure 6:
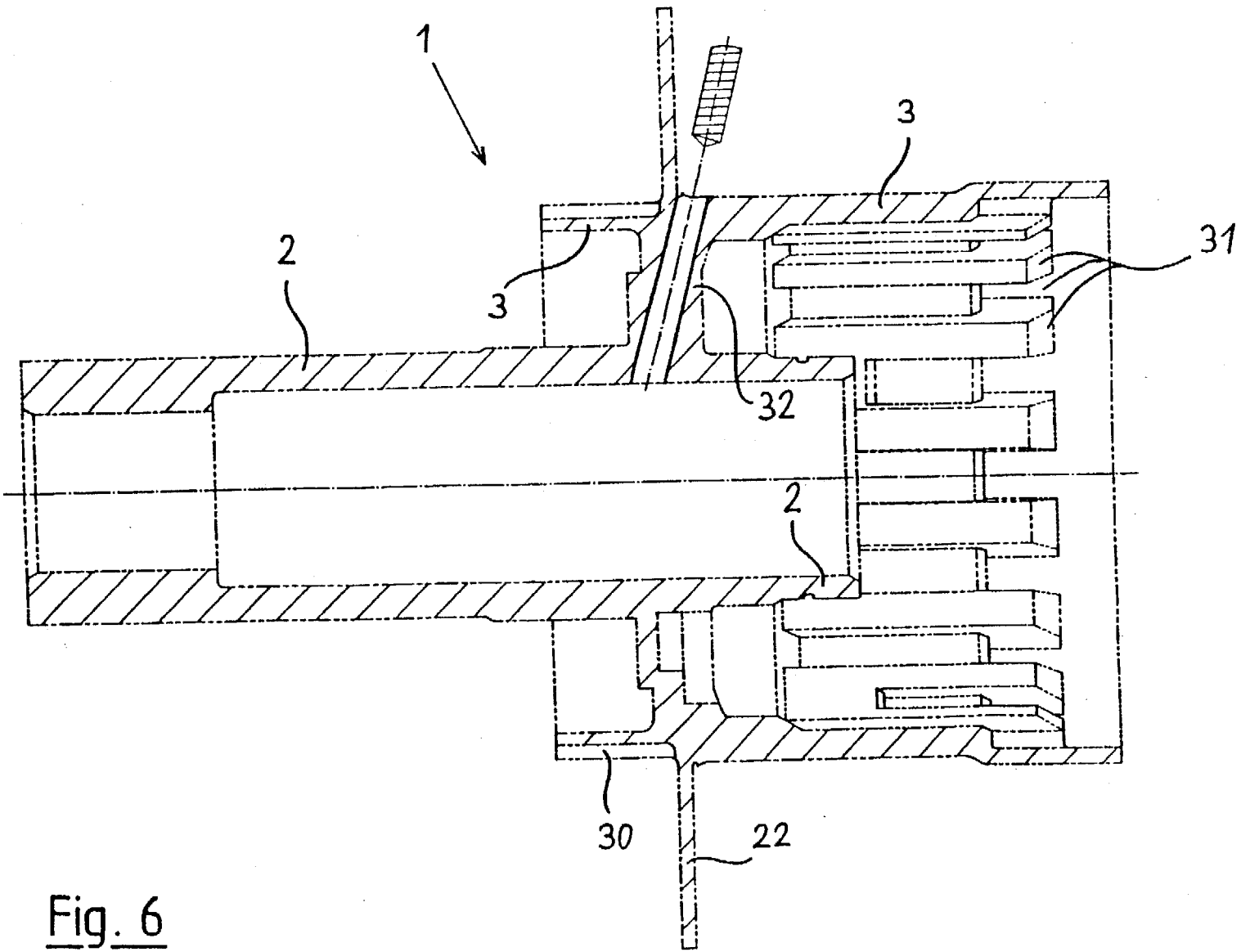
FIG. 6 is the work-piece blank of FIGS. 4 and 5 after a partial forming by rolling.

By further forming during the rolling operation, a first hollow member 3 has been formed out of the two wings 21 and 23 as illustrated in FIG. 6 with the hollow member extending in axial direction of the work-piece blank 1 from the hub part 32 to both axial directions. The middle wing 22 produced by the splitting operation in this state still is unchanged and not transformed.

Figure 7:
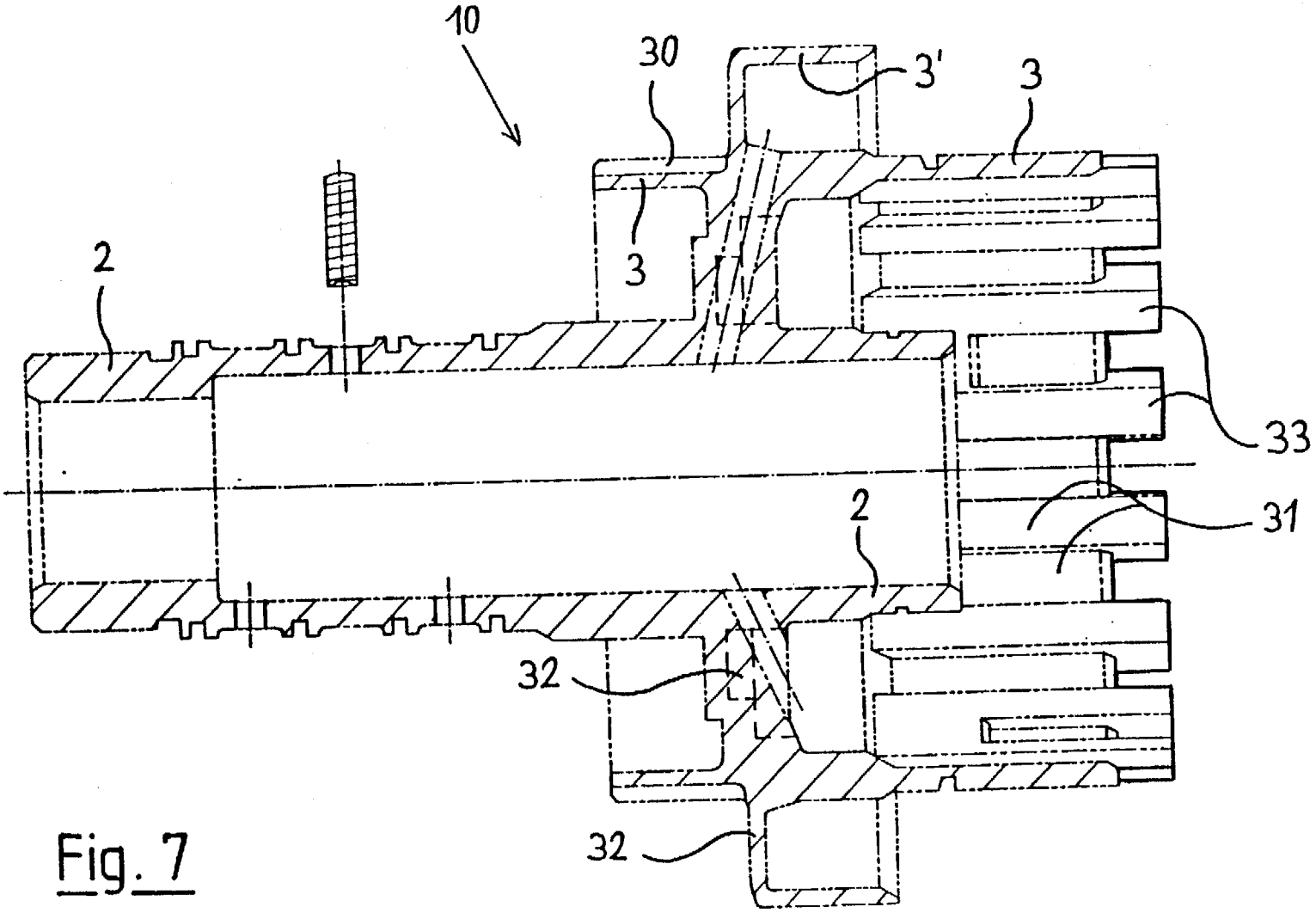
FIG. 7 is a finished work-piece produced out of the second work-piece blank according to FIGS. 4, 5 and 6.

Also by rolling, a second hollow member 3' is formed out of the third wing 22, as illustrated in FIG. 7 of the drawing, with the second hollow member positioned radially outwards of the first hollow member 3 and comprising a smaller axial length than the first hollow member. Furthermore, the second hollow member 3' extends only in one direction from the hub part 32 in axial direction of the spindle 2. The thus formed work-piece 10 shown in FIG. 7 comprises two hollow members 3 and 3' arranged coaxially to each other and to the spindle 2 wherein also the hollow member 3' may be comprised with an inner and/or outer profile which is not illustrated.

Furthermore, FIG. 7 illustrates an embodiment of the right frontal end of the first hollow member 3 with a serration 33. This serration 33 is formed such that firstly, the hollow member 3 during the transforming by rolling is comprised with an inner profile 31 varying in the depth thereof in radial direction, with the serration positioned adjacent to the frontal end area of the hollow member 3.

By subsequent turning the outer circumference of the hollow member 3 in the frontal end area thereof (the free axial end), material is removed to such a degree, that the crown-like serration 33 is formed.

Figure 8:
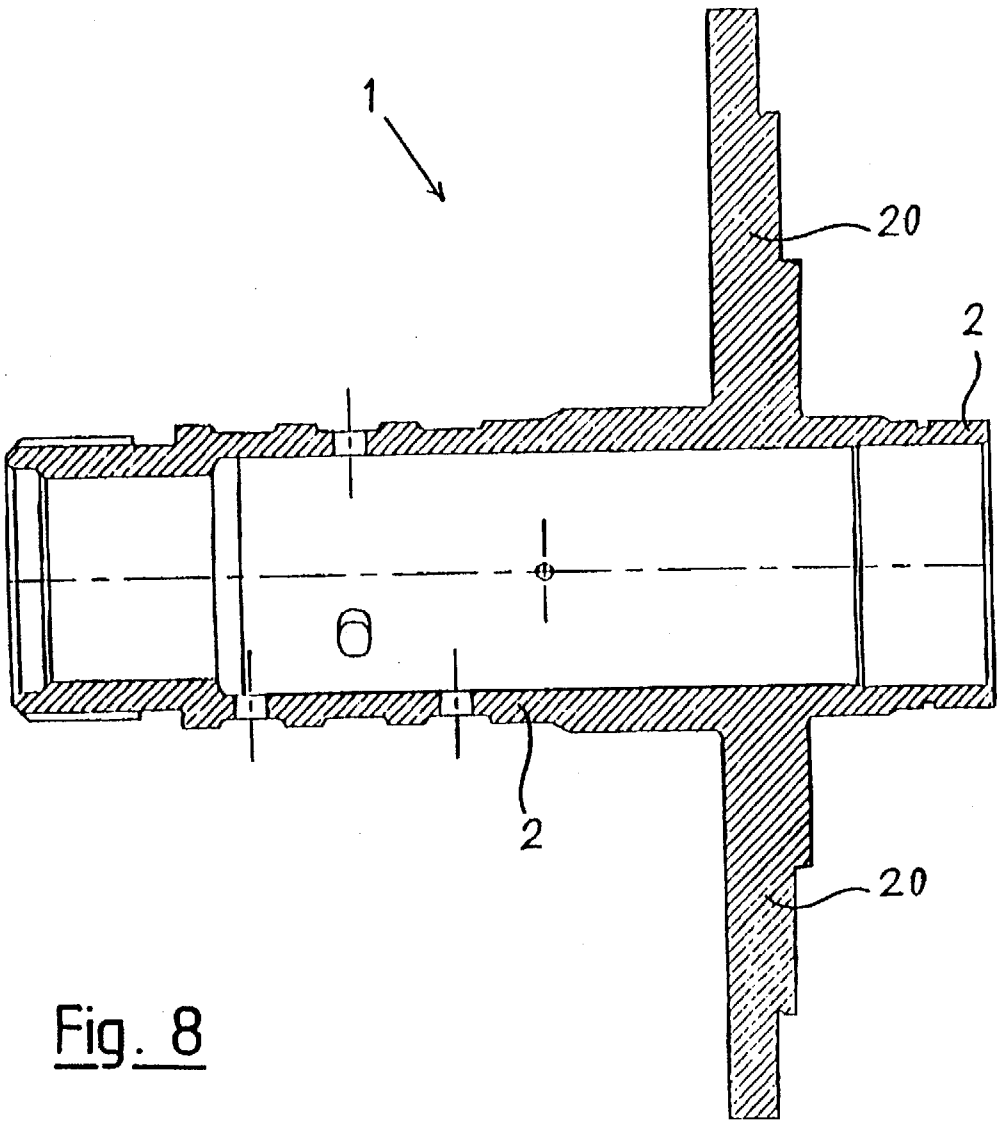
FIG. 8 is a third work-piece blank after the machining thereof and prior to the forming by rolling, also in a longitudinal section.

FIG. 8 of the drawing illustrates a third work-piece blank 1 which is also formed out of a hollow spindle 2 and a flange-like extension 20 which extends from the outer circumference of the spindle 2 integrally outwards.

Figure 9:
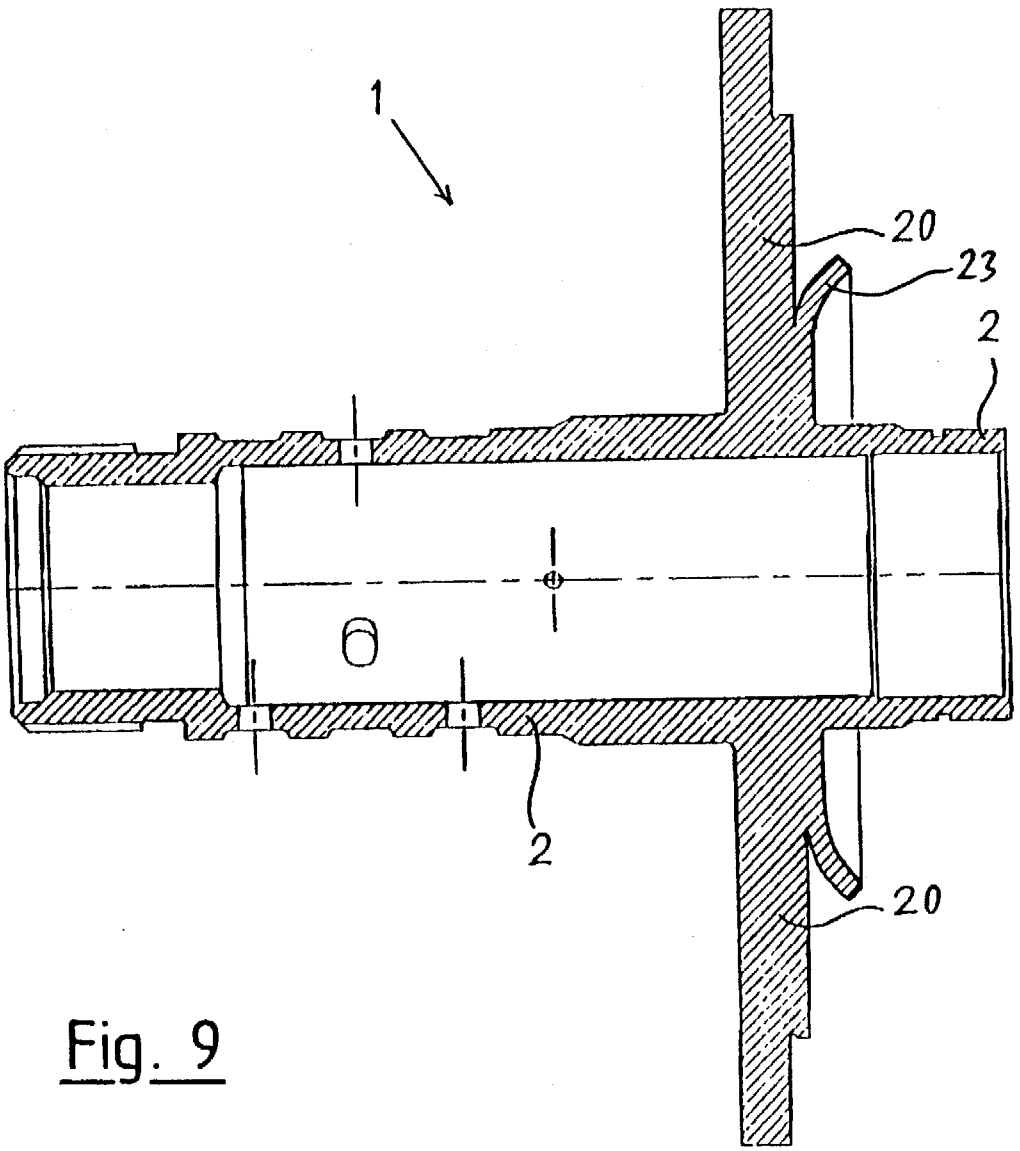
FIG. 9 is the work-piece blank of FIG. 8 during a first forming by rolling.

FIG. 9 illustrates the work-piece blank 1 of FIG. 8 after a first splitting operation wherein a wing 23 is split off from the flange-like extension 20.

Figure 10:
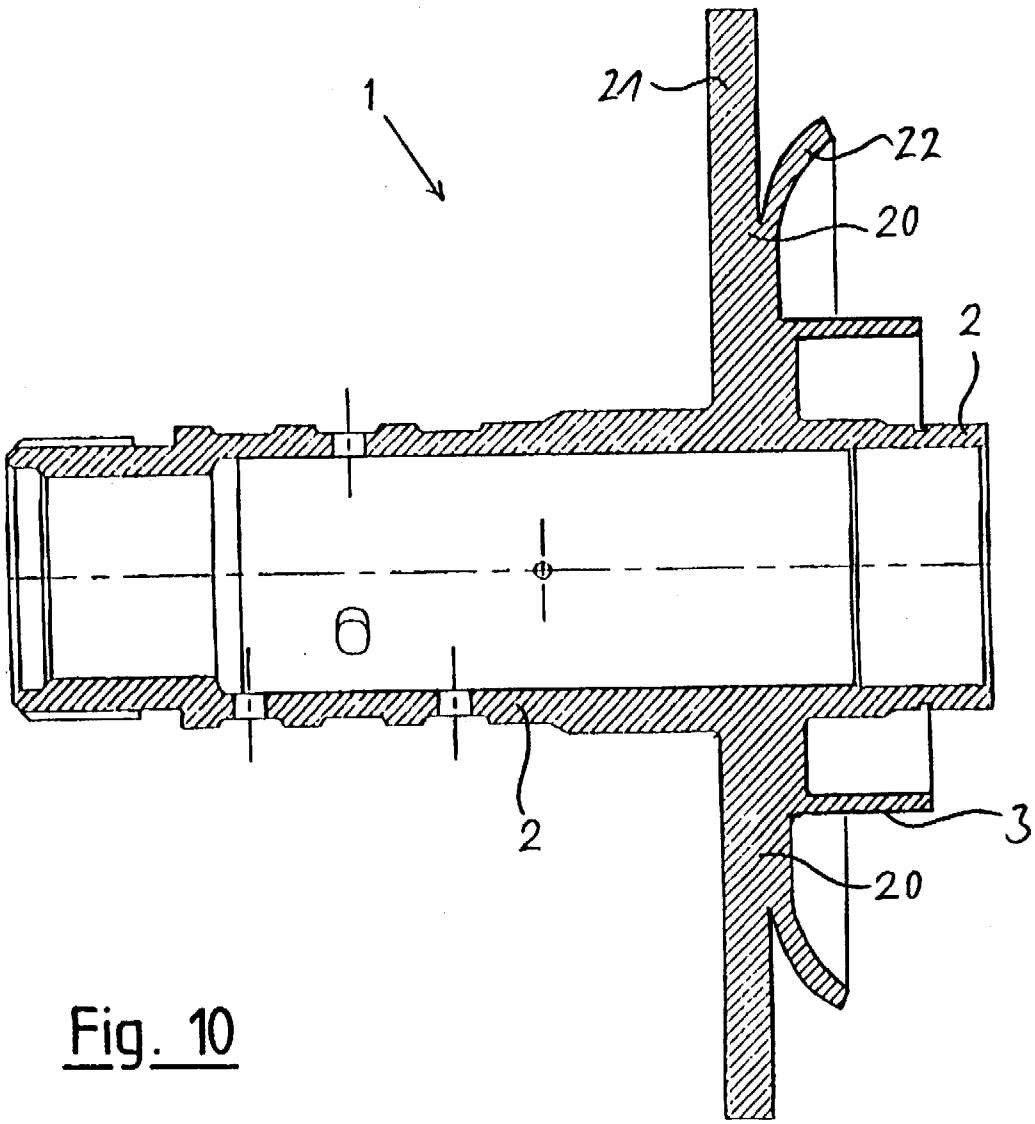
FIG. 10 is the work-piece blank of FIG. 8 during a further forming by rolling.

According to FIG. 10 this split off first wing 23 is transformed to a first hollow member 3 extending in radially spaced relation coaxially to the spindle 2.

As has been explained before, this first hollow member 3 may be comprised with an inner and/or outer profile which is not shown in the drawing. Furthermore, FIG. 10 illustrates that the remaining part of the flange-like extension 20 is split in a further splitting operation into two wings 21 and 22.

Figure 11:
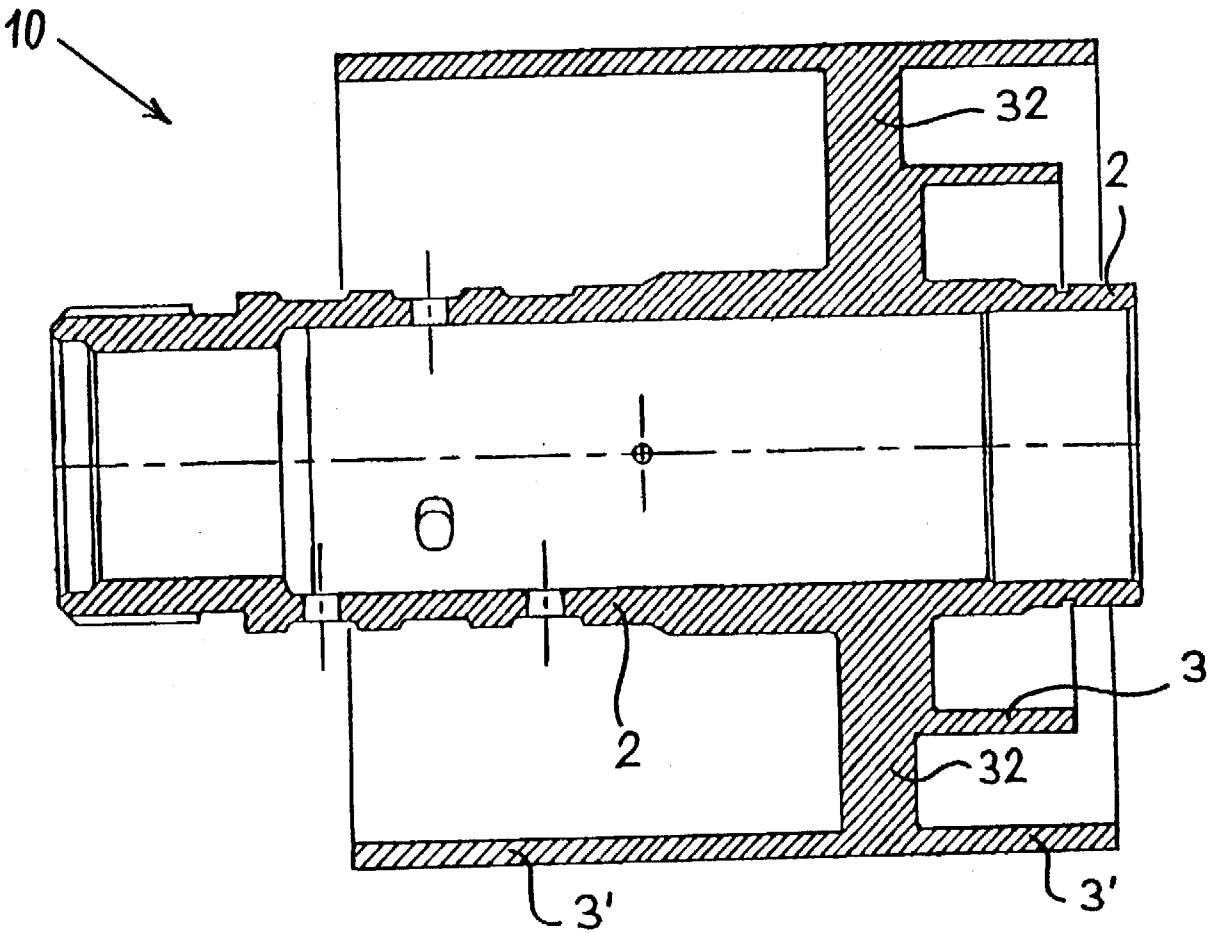
FIG. 11 is a third finished work-piece produced out of the third work-piece blank according to FIGS. 8, 9 and 10.

According to FIG. 11, these two further wings 21 and 22 of the flange-like extension 20, are transformed into a second hollow member 3' which operation is also attained by rolling. The hollow member 3' extends to both axial sides from the hub part 32 of the finished work-piece 10 and comprises a larger diameter than the first hollow member 3 extending only to one axial side from the hub part 32.

Finally, FIG. 12 of the drawing illustrates a special roller 4 wherein in the drawing only the one half of the rotation symmetrical roller below the rotation axis 40 is illustrated. This roller 4 is characterized in that it is shaped as a double split roller and correspondingly comprises two splitting edges 41 and 42 which are spaced apart from each other in axial direction. A rectangular groove 43 is positioned between the two splitting edges 41, 42.

Figure 12:
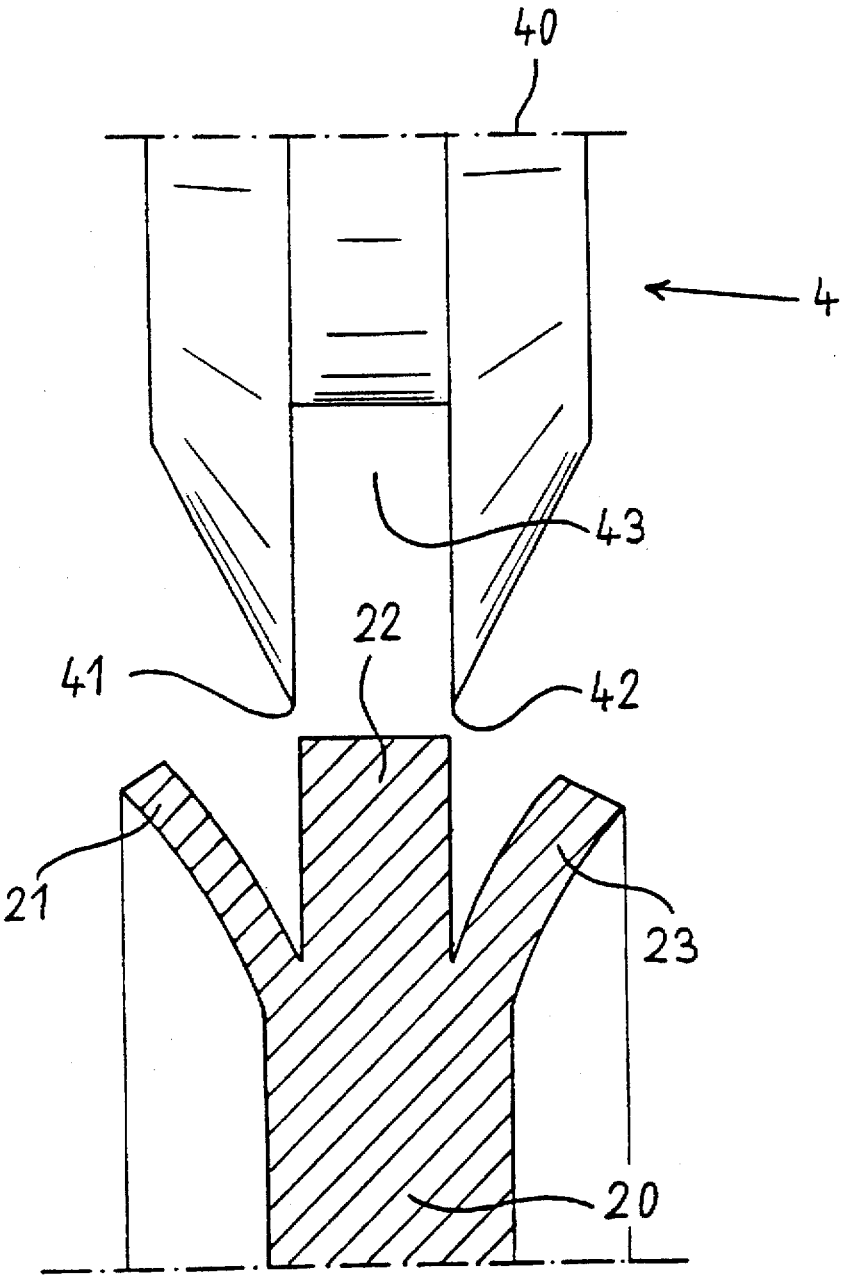
FIG. 12 is a roller shaped as a double split roller with a work-piece processed with the roller.

In the lower part of the FIG. 12 a part 20 of any work-piece is illustrated which has been processed in the circumferential area thereof with the roller 4 which is the top part in the drawing. As is obvious in FIG. 12, the work-piece 20 has been split into three wings 21, 22, 23 in total, beginning from the outer circumference thereof, with the roller 4 moving in radial direction, i.e., in the plane of the drawing in the direction towards the work-piece 20. In this operation, the two outer wings 21, 23 have been bent to the left or the right side, respectively, in correspondence with the extension of the flanks laterally outwards of the two splitting edges 41 and 42, whereas the middle wing 22 of the work-piece 20 has not been transformed. With this moved roller 4, the middle wing 22 is positioned within the groove 43 of the roller 4 such that the splitting operation is not impaired. The maximal splitting depth to be achieved with the roller 4 is preset by the depth of the groove 43 in radial direction of the roller 4.

As is apparent from the foregoing specification, the invention is susceptible of being embodied with various alterations and, modifications which may differ particularly from those that have been described in the preceding specification and description. It should be understood that we wish to embody within the scope of the patent warranted hereon all such modifications as reasonably and properly come within the scope of our contribution to the art.

We claim as our invention:

1. A method for manufacturing a rotationally symmetrical work-piece of steel comprising a hardened spindle and at least one hollow member connected with the spindle by a hub part extending in radial direction, wherein the following method steps are performed:

a) producing a steel work-piece blank having an integral outwardly protruding circumferential flange-like extension and an axis of rotation;

b) mechanically processing the steel work-piece blank by at least one of boring, turning, milling, pressing, and grinding; and c) splitting a radially outer part of said flange-like extension into at least two wings in radial direction by using a single roller member having an axis of rotation parallel to the axis of rotation of the work-piece blank and rolling a radially outer part of said portion of the flange-like extension in two axial directions to form the hollow member.

2. A method according to claim 1, wherein step c) further comprises the steps of:

splitting the radially outer part of the flange-like extension into three wings in radial direction;

forming a first hollow member from two outer wings of the three wings, the first hollow member extending from the hub part in two axial directions; and forming a second hollow member extending from the hub part in one axial direction and encompassing the first hollow member in a radially spaced relation at least along a part thereof.

3. A method according to claim 1, wherein step c) further comprises the steps of:

splitting the radially outer part of the flange-like extension into three wings in radial direction;

forming a first hollow member from an outer wing of the three wings, the first hollow member extending from the hub part in one axial direction; and forming a second hollow member from two remaining wings, the second hollow member extending from the hub part in two axial directions and encompassing the first hollow member in a radially spaced relation along at least a part thereof.

4. A method according to claim 1, further comprising the step of:

surface hardening the work-piece blank between steps b) and c) only in a part thereof forming the spindle, while avoiding a hardening of the flange-like extension.

5. A method according to claim 1, further comprising the step of:

normalizing the work-piece blank by heat treatment between steps a) and b).

6. A method according to claim 1, further comprising the step of:

d) machining the hollow member by at least one of turning, grinding and cutting into length at a terminal end thereof.

7. A method according to claim 1, further comprising the step of:

flow-turning the radially outer part of the flange-like extension into the hollow member while thinning material of the outer part and axially enlarging the length thereof.

8. A method according to claim 1, further comprising the step of:

providing the hollow member with at least one of an outer and an inner profile during the forming of the hollow member by rolling.

9. A method according to claim 1, wherein step c) further comprises the steps of:

lobarly thickening the radially outer part of the flange-like extension; and forming the hollow member from the thickened part of the extension extending from the hub part in two axial directions.

10. A method according to claim 8, further comprising the steps of:

forming the hollow member with an inner profile varying in a radial depth thereof as seen in circumferential direction; and forming a serration in a front end area of the hollow member by subsequently turning the outer circumference of the hollow member.

11. A method for manufacturing a steel work-piece which is rotationally symmetrical about an axis comprising a spindle and at least one hollow member connected with the spindle by a hub part extending in radial direction, comprising the steps:

a) producing a steel work-piece blank having said rotationally symmetrical spindle and an integral, rotationally symmetrical, radially outwardly extending circumferential flange and an axis of rotation;

b) mechanically processing said steel work-piece blank by at least one of boring, turning, milling, pressing, and grinding; and c) splitting a radially outer part of said flange into a plurality of split members in a radial direction by using a single roller member having an axis of rotation parallel to said axis of rotation of said work-piece and rolling at least two of said plurality of split members of said flange to form said hollow member extending in two axial directions and leaving a remainder of said flange unchanged to form said hub.

12. A method according to claim 11, wherein step c) is divided into a part-step c1) wherein the radially outer part of said flange-like extension is split into three wings in radial direction, and into a part-step c2) wherein a first hollow member is formed out of two outer wings of said three wings with said hollow member extending from said hub part in two axial directions, and into a part-step c3) wherein a second hollow member extending from said hub part in one axial direction and encompassing said first hollow member in a radially spaced relation at least along a part thereof.

13. A method according to claim 11, wherein step c) is divided into a part-step c1) wherein the radially outer part of said flange-like extension is split into three wings in radial direction, and into a part-step c2) wherein a first hollow member is formed out of one outer wing of said three wings with said hollow member extending from said hub part in one axial direction, and into a part-step c3) wherein a second hollow member is formed out of a remaining two of said three wings with said second hollow member extending from said hub part in two axial directions and encompassing said first hollow member in a radially spaced relation along at least a part thereof.

14. A method according to claim 11, wherein between steps b) and c) the work-piece blank is surface hardened, wherein said surface hardening of the work-piece blank is accomplished only in the part thereof forming the spindle, while avoiding a hardening of said flange-like extension.

15. A method according to claim 11, wherein between steps a) and b) said work-piece blank is normalized by heat treatment.

16. A method for manufacturing a steel work-piece which is rotationally symmetrical about an axis comprising a spindle and at least one hollow member connected with the spindle by a hub part extending in radial direction, comprising the steps of:

a) producing a steel work-piece blank having said rotationally symmetrical spindle and an integral, rotationally symmetrical, radially outwardly extending circumferential flange, said work-piece having an axis of rotation;

b) mechanically processing said steel work-piece blank by at least one of boring, turning, milling, pressing, and grinding; and c) splitting a portion of said flange by using a single roller member having an axis of rotation parallel to said axis of rotation of said work-piece and rolling a radially outer part of said flange to form said hollow member extending in two axial directions and leaving a remainder of said flange unchanged to form said hub.

* * * * *